US007431774B2

(12) United States Patent
Kim

(10) Patent No.: US 7,431,774 B2
(45) Date of Patent: Oct. 7, 2008

(54) FILTER ASSEMBLY OF DISHWASHER

(75) Inventor: Yong Hee Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 476 days.

(21) Appl. No.: 10/721,736

(22) Filed: Nov. 26, 2003

(65) Prior Publication Data

US 2004/0163690 A1 Aug. 26, 2004

(30) Foreign Application Priority Data

Nov. 28, 2002 (KR) ..... 10-2002-0074989

(51) Int. Cl.
*B08B 7/04* (2006.01)
*B08B 3/04* (2006.01)

(52) U.S. Cl. ..... 134/18; 134/57 D; 134/104.1; 134/104.4; 134/111

(58) Field of Classification Search ..... 134/57 D, 134/109, 110, 111, 135, 173–175, 104.1–104.4, 134/18
See application file for complete search history.

(56) References Cited

U.S. PATENT DOCUMENTS 2,392,901 A * 1/1946 Brown ..... 210/416.5
3,122,148 A * 2/1964 Arthur ..... 134/56 D
3,179,116 A * 4/1965 Jacobs ..... 134/56 D
3,297,163 A * 1/1967 Landon ..... 210/331
3,926,804 A * 12/1975 McClure ..... 210/779
4,308,142 A * 12/1981 Braukmann et al. ..... 210/355
5,711,325 A * 1/1998 Kloss et al. ..... 134/104.1
6,811,617 B2 * 11/2004 Elick et al. ..... 134/10
2002/0008068 A1 * 1/2002 Anderson ..... 210/741
2003/0034052 A1 * 2/2003 Kiesler et al. ..... 134/18

* cited by examiner

*Primary Examiner*—Michael Barr
*Assistant Examiner*—Rita R Patel
(74) *Attorney, Agent, or Firm*—Ked & Associates, LLP

(57) ABSTRACT

A filter assembly for a dishwasher is provided. The filter assembly includes a water circulator for supplying washing and rinsing water under pressure to the filter assembly, and at least one cleaning nozzle positioned at a predetermined position adjacent an outer circumference of the filter assembly. The at least one cleaning nozzle is provided in communication with the water circulator, and prevents excessive accumulation of waste particles in the filter assembly by periodically spraying pressurized water into the filter assembly.

19 Claims, 3 Drawing Sheets

FILTER ASSEMBLY OF DISHWASHER

This application claims the benefit of Korean Application No. 10-2002-0074989 filed on Nov. 29, 2002, which is hereby incorporated by reference.

BACKGROUND OF THE INVENTION

1. Field of the Invention

The present invention relates to a dishwasher, and more particularly, to a filter assembly employing a cleaning nozzle to clean the filters of a dishwasher.

2. Discussion of the Related Art

Referring to FIG. 1, a general dishwasher is comprised of a washtub 4, installed in a body 2 forming an exterior, for holding tableware and the like on a sliding rack 12; a sump 6, installed under the washtub, for collecting runoff water; a plurality of injection nozzles 14 for spraying water toward the rack from an injection passage 14*a* connected to the sump; a wash pump assembly 8, installed at one side of the sump, for circulating water using a wash pump 8*b* connected to a pump body 8*a;* a drain pump assembly 10, installed at the other side of the sump, for draining the water; and a filter assembly 20, installed in a filter holder 6*a* provided at a center of the sump, for filtering waste particles from the water before draining or re-circulating.

The filter assembly 20 includes a series of concentrically first, second, and third filters 22, 24, and 26, each of which is provided with a progressively larger receptacle for fitting one into the other. Accordingly, as the circulating water passes through the filters 22, 24, and 26, large waste particles are filtered prior to smaller particles. After using the dishwasher, a user manually removes from the filters 22, 24, and 26 the waste filtered by the filter assembly 20.

In the above dishwasher using a filter assembly according to the related art, however, minute particles of waste tend to accumulate on the outer filter 26, to block the filters and impede water circulation accordingly. A reduction of water circulation degrades washing performance, and a complete blockage will preclude operation and force the user to clean the filters manually.

SUMMARY OF THE INVENTION

Accordingly, the present invention is directed to a filter assembly of a dishwasher that substantially obviates one or more of the problems due to limitations and disadvantages of the related art.

An object of the present invention, which has been devised to solve the foregoing problem, lies in providing a filter assembly of a dishwasher, by which the undue accumulation of waste particles filtered from circulating water is prevented by periodically spraying water directly into the filter assembly.

It is another object of the present invention to provide a filter assembly of a dishwasher, which facilitates water circulation to improve wash performance.

It is another object of the present invention to provide a filter assembly of a dishwasher, which reduces the need for the filters of the filter assembly to be cleaned manually.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided a filter assembly for filtering waste particles in a dishwasher. The filter assembly comprises water circulating means for supplying washing and rinsing water under pressure to the filter assembly; and at least one cleaning nozzle, provided at a predetermined position along an outer circumference of the filter assembly, to communicate with the water circulating means, wherein the pressurized water of the water circulating means is sprayed into the filter assembly.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiment of the present invention, examples of which are illustrated in the accompanying drawings. Throughout the drawings, like elements are indicated using the same or similar reference designations where possible.

The present invention is directed towards the filter assembly for filtering waste particles in a dishwasher. The filter assembly is comprised of series of concentrically arranged filters having varyingly sized filter holes, respectively, wherein the outer filter of the filter assembly has the smallest holes.

Figure 1:
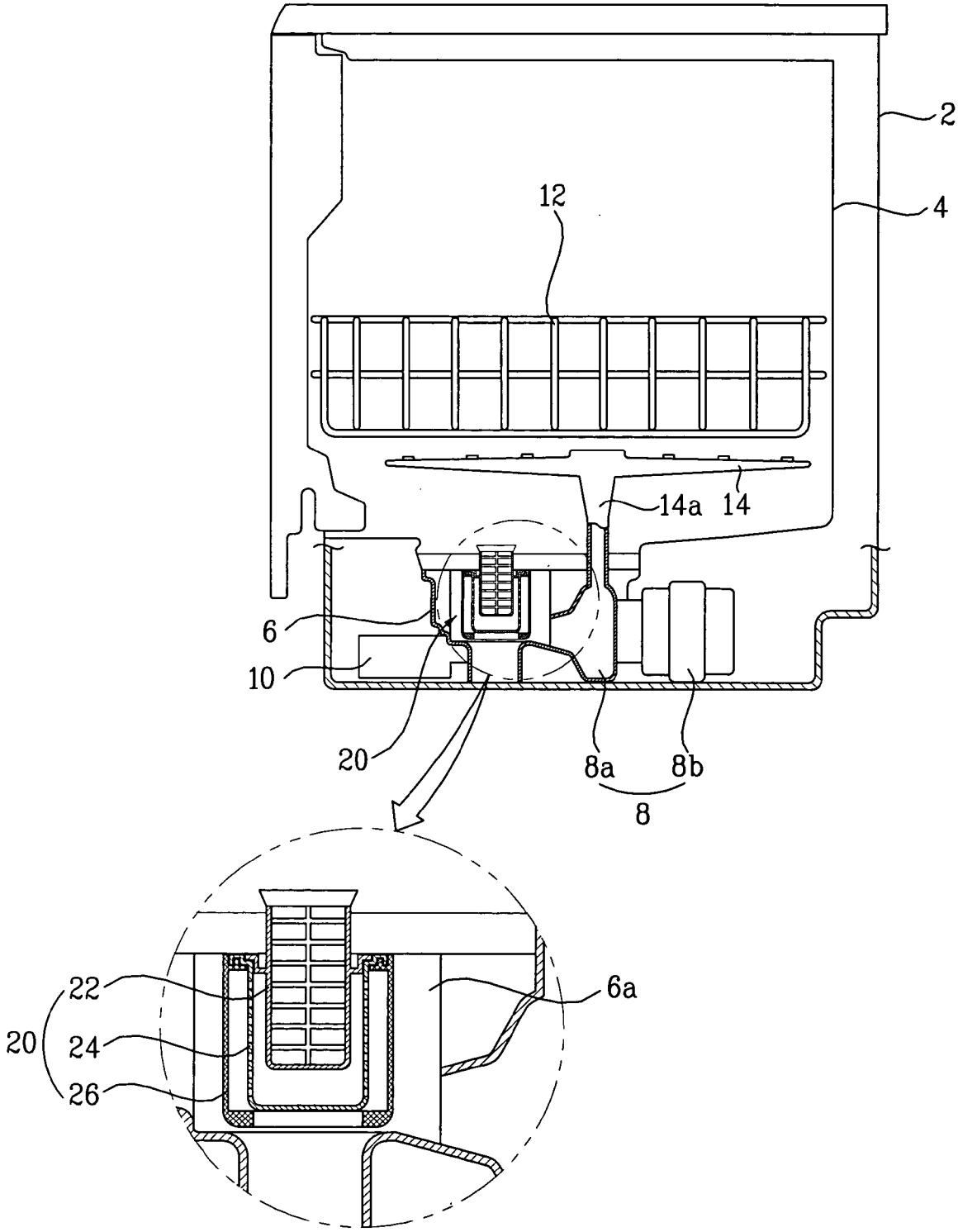
FIG. 1 Related Art
FIG. 1 is a cross-sectional view of a general dishwasher.
Figure 2:
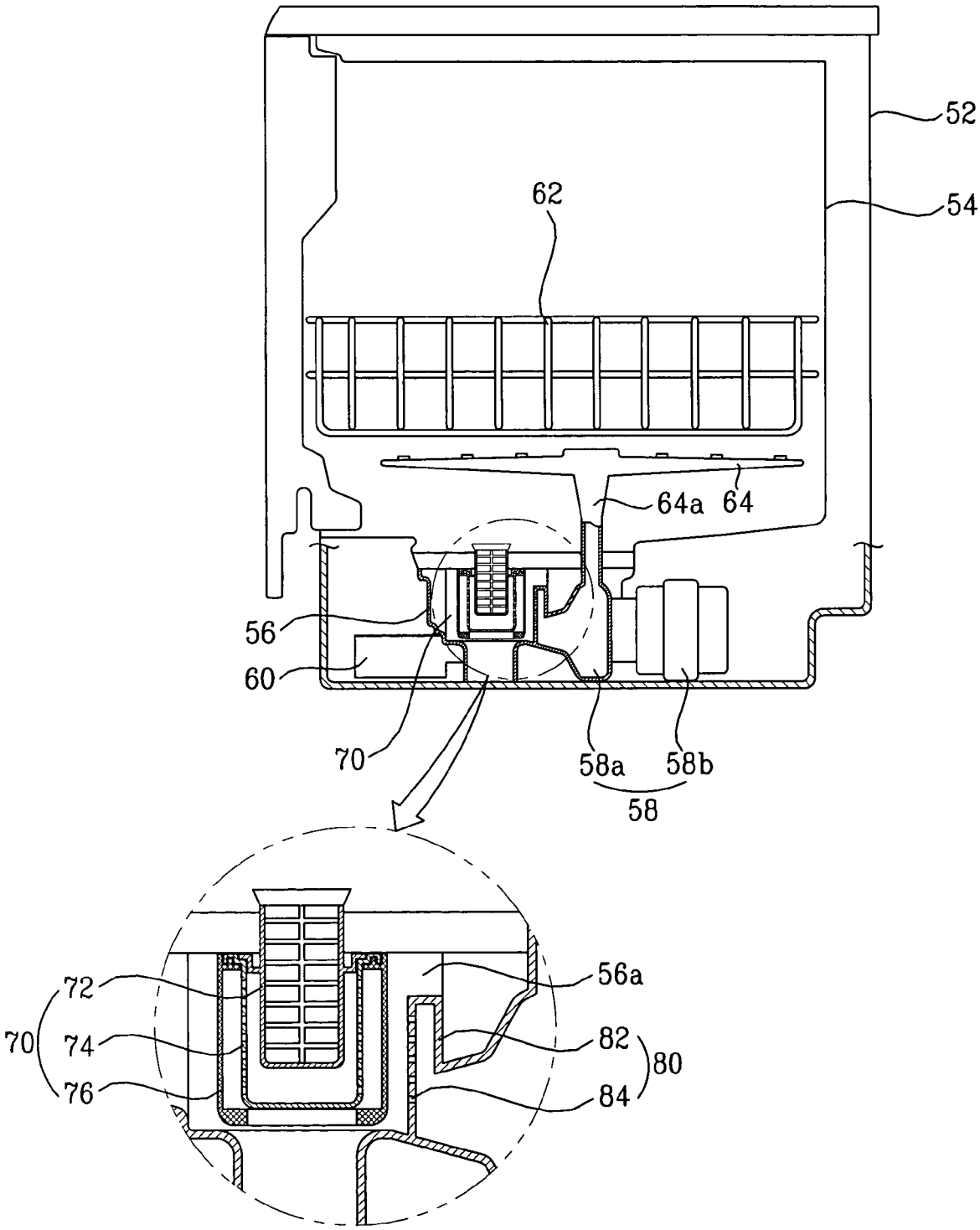
FIG. 2 is a cross-sectional view of a dishwasher adopting a filter assembly according to the present invention.
Figure 3:
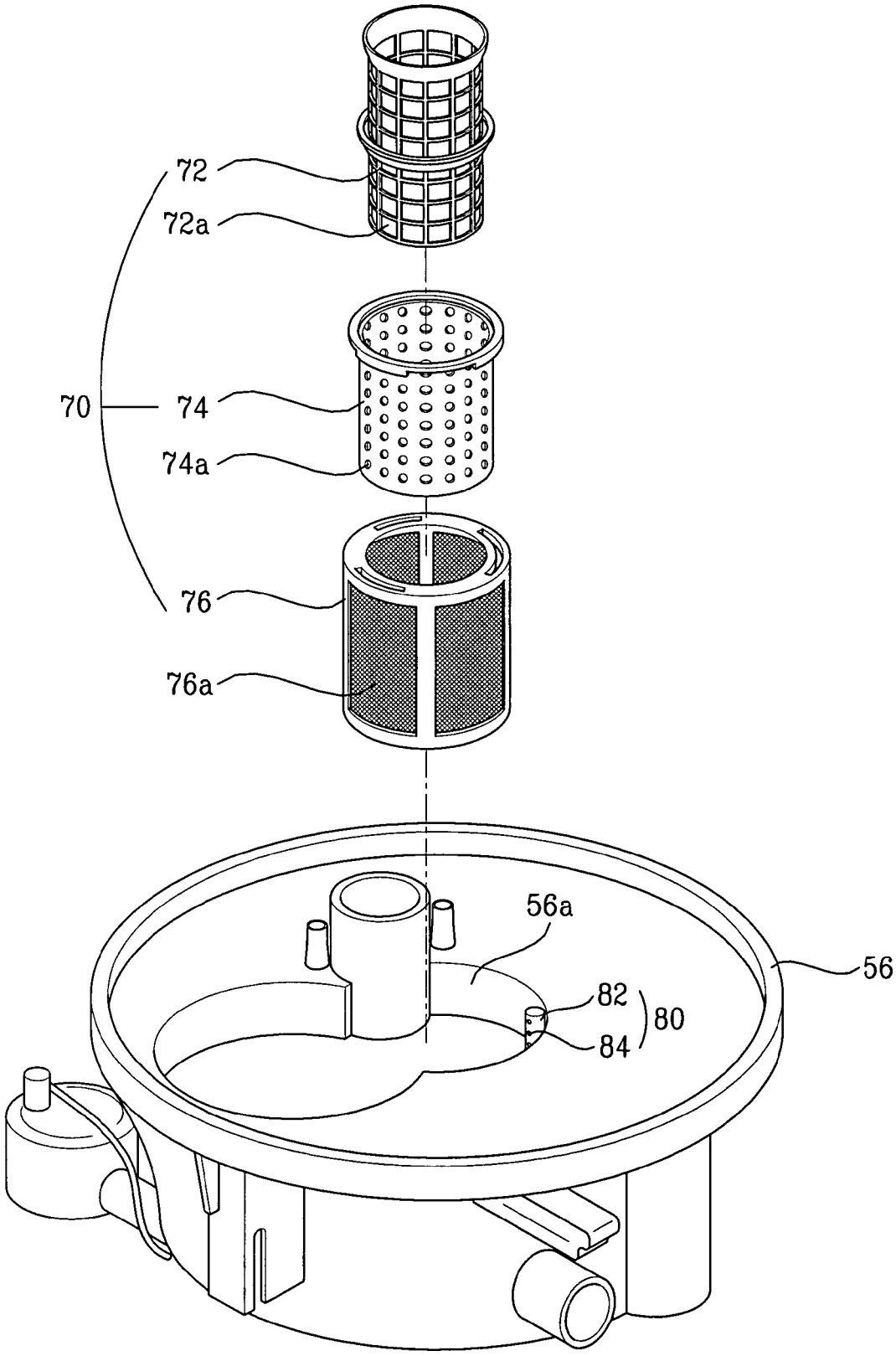
FIG. 3 is a perspective breakaway view of an apparatus for cleaning filters in a dishwasher according to the present invention.

Referring to FIGS. 2 and 3, a dishwasher adopting a filter assembly according to the present invention is comprised of a washtub 54, installed in a body 52 forming an exterior, for holding tableware and the like on a sliding rack 62; a sump 56, installed under the washtub, for collecting runoff water; a plurality of injection nozzles 64 for spraying water toward the rack from an injection passage 64*a* connected to the sump; a wash pump assembly 58, installed at one side of the sump, for circulating water using a wash pump 58*b* connected to a pump body 58*a;* a drain pump assembly 60, installed at the other side of the sump, for draining the water; and a filter assembly 70, installed in a filter holder 56*a* provided at a center of the sump, for filtering waste particles from the water before draining or re-circulating.

The filter assembly 70 includes a series of concentrically arranged first, second, and third filters 72, 74, and 76, each of which is provided with a progressively larger receptacle for fitting one into the other. The first, second, and third filters 72, 74, and 76 are provided with a multitude of progressively smaller filter holes 72*a,* 74*a,* and 76*a,* respectively, to filter larger particles prior to smaller particles. The third filter 76 is fixed to the filter holder 56*a* of the sump 56, the second filter 74 is detachably installed in the third filter 76, and the first filter 72 is detachably installed in the second filter 74. Accordingly, large, medium-sized, and small waste particles are filtered by the first to third filters 72, 74, and 76, respectively, with the third filter filtering the most minute particles.

In addition, a cleaning nozzle 80 is installed adjacent the outer circumference of the third filter 76 of the filter assembly 70. The cleaning nozzle 80, which is thus juxtaposed to the third filter 76 having the smallest holes, comprises a cylindrical nozzle body 82 installed in the filter holder 56*a* of the sump 56, to communicate with a water supply valve assembly (not shown) and the wash pump assembly 58; and a multitude of injection holes 84 perforating in the nozzle body, so as to face the filter assembly 70. Accordingly, using the water from a water circulating means comprised of the sump 56, the water supply valve assembly, and the wash pump assembly 58, water is periodically upon the supply of water to the water circulating means sprayed through the injection holes 84 of the cleaning nozzle 80 directly into the filter assembly 70. Hydraulic pressure, provided by the water pump of the water circulating means, is used to clean the filter assembly whenever water is supplied for washing or rinsing. Thus, there is no need for a separate pressurizing device. According to the present invention, a plurality of cleaning nozzles 80, each having a number of injection holes 84 formed at intervals in a nozzle body 82, are preferably formed at predetermined positions along the outer circumference of the filter assembly 70. The size of the resulting number of injection holes 84 formed in the nozzle body 82 is determined by the pressure of water supplied by a service pipe supplying pressurized water to the water circulating means.

In the operation of the dishwasher according to the present invention, with water supplied, the wash pump 58*b* is actuated to perform the washing of tableware placed in the rack 62, whereupon the water in the sump 56 is sprayed toward the rack via the injection passage 64*a* and the nozzles 64. The water thus circulates through the sump 56, injection passage 64*a*, nozzles 64, and washtub 54. Waste particles from the tableware are filtered from the circulating water in the filter assembly 70 installed in the sump 56, with filtering progressing as water circulates via the water circulating means. A similar process is executed for rinsing.

That is, during washing and rinsing, as water is supplied to the sump via the water supply valve, the water is sprayed via the cleaning nozzle 80 directly into the third (outer) filter 76, and indirectly into the second and first (inner) filters 74 and 72, whereby waste particles are filtered from the circulating water and the most minute particles of the third filter are cleaned periodically. Hence, the blocking of water circulation due to the accumulation of particles on the third filter 76 is prevented, to reduce the need for the filter to be cleaned manually. The spraying action of the cleaning nozzle 80 also reduces blockage in the filter holes 72*a* and 74*a* of the inner filters. Thus, water circulation is facilitated and wash performance is improved accordingly.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A filter assembly for a dishwasher, the filter assembly comprising:

a plurality of concentrically nested filters varying in size in a radial direction, wherein an outermost filter of the filter assembly has the smallest holes of each of the plurality of concentrically nested filters;

water circulating means for supplying washing and rinsing water under pressure to the filter assembly, the water circulating means comprising a wash pump assembly configured to circulate water and a sump configured to collect runoff water; and at least one stationary cleaning nozzle provided at a predetermined position adjacent an outer circumference of the filter assembly facing the outermost filter of the plurality of concentrically nested filters, wherein the at least one cleaning nozzle is fixed to a portion of the sump proximate the filter assembly so as to be in communication with said water circulating means, and wherein the at least one cleaning nozzle is configured to spray pressurized water supplied by said water circulating means into the filter assembly.

2. The filter assembly as claimed in claim 1, wherein the plurality of filters of the filter assembly have filter holes of respectively varying size.

3. The filter assembly as claimed in claim 1, wherein said at least one cleaning nozzle comprises a nozzle body and a plurality of injection holes perforating the nozzle body.

4. The filter assembly as claimed in claim 3, wherein a size of the injection holes perforating the nozzle body is selected based on a pressure of said pressurized water supplied by said water circulating means.

5. The filter assembly as claimed in claim 1, wherein the at least one cleaning nozzle is configured to spray pressurized water onto the outermost filter of the filter assembly so as to release particles trapped therein.

6. The filter assembly as claimed in claim 1, further comprising a filter holder provided in the sump, wherein the filter holder is configured to hold the filter assembly, and wherein the at least one cleaning nozzle comprises a tubular nozzle body disposed adjacent an outer circumferential surface of the outermost filter.

7. The filter assembly as claimed in claim 1, wherein the plurality of concentrically nested filters comprises a first substantially cylindrical filter disposed within a second substantially cylindrical filter disposed within a third substantially cylindrical filter, wherein the first, second and third filters comprise a first, second and third plurality of holes, respectively, and wherein each of the third plurality of holes is smaller than each of the second plurality of holes, and each of the second plurality of holes is smaller than each of the first plurality of holes.

8. The filter assembly as claimed in claim 7, wherein the at least one cleaning nozzle is configured to spray pressurized water at the filter assembly such that particles adhered to the first, second and third filters are dislodged by the pressurized water.

9. A dishwasher comprising the filter assembly of claim 1.

10. The filter assembly as claimed in claim 1, wherein the plurality of concentrically nested filters comprises a plurality of substantially cylindrical filters, wherein the outermost filter is positioned at an outermost radial position of the plurality of filters.

11. The filter assembly as claimed in claim 10, wherein the at least one stationary cleaning nozzle is positioned substantially parallel to an outer wall of the outermost filter such that the at least one stationary cleaning nozzle sprays pressurized water in a direction substantially orthogonal to the outer wall of the outermost filter.

12. The filter assembly as claimed in claim 1, wherein an upper rim of each filter of the plurality of concentrically nested filters is supported on an upper rim of an adjacent filter, and an upper rim of the outermost filter is supported by a corresponding portion of the sump.

13. A filtration assembly for a home appliance, comprising:

a pump assembly configured to supply pressurized washing fluid and to circulate the washing fluid;

a sump configured to collect washing fluid therein;

a filter assembly coupled to the sump and configured to filter particles from washing fluid passing therethrough, wherein the filter assembly comprises a plurality of concentrically nested filters varying in size in a radial direction, the plurality of concentrically nested filters being disposed within a filter holding portion of the sump; and at least one stationary cleaning nozzle coupled to at least one of the sump or the pump and configured to direct pressurized washing fluid onto the filter assembly so as to cause particles to be released from the filter assembly, wherein the at least one cleaning nozzle comprises a substantially tubular nozzle body with a plurality of injection holes formed therein, and wherein the at least one cleaning nozzle is disposed adjacent an outer circumferential surface of an outermost filter of the plurality of concentrically nested filters such that the nozzle body and the plurality of injection holes formed therein are disposed substantially parallel to a central axis of the plurality of concentrically nested filters.

14. The filter assembly as claimed in claim 13, wherein the plurality of concentrically nested filters comprises a first filter disposed within a second filter disposed within a third filter.

15. The filter assembly as claimed in claim 14, wherein the first, second and third filters comprise a first, second and third plurality of holes, respectively, and wherein each of the third plurality of holes is smaller than each of the second plurality of holes, and each of the second plurality of holes is smaller than each of the first plurality of holes.

16. The filter assembly as claimed in claim 13, wherein a size and a number of the plurality of injection holes formed in the nozzle body is selected based on a predetermined pressure of washing fluid supplied thereto.

17. A dishwasher comprising the filter assembly of claim 13.

18. The filter assembly as claimed in claim 13, wherein the plurality of concentrically nested filters are substantially cylindrical, and wherein the outermost filter occupies a radially outermost position of the plurality of filters.

19. The filter assembly as claimed in claim 13, wherein an upper rim of each filter of the plurality of concentrically nested filters is supported on an upper rim of an adjacent filter, and an upper rim of the outermost filter is supported by a corresponding portion of the sump.

* * * * *